US008033233B2

(12) United States Patent
Strong

(10) Patent No.: US 8,033,233 B2
(45) Date of Patent: Oct. 11, 2011

(54) RETRACTABLE MOORING CLEAT

(76) Inventor: Nathan Paul Strong, Auckland (NZ)

( * ) Notice: Subject to any disclaimer, the term of this patent is extended or adjusted under 35 U.S.C. 154(b) by 282 days.

(21) Appl. No.: 11/920,699

(22) PCT Filed: May 9, 2006

(86) PCT No.: PCT/NZ2006/000100

§ 371 (c)(1),
(2), (4) Date: Dec. 8, 2008

(87) PCT Pub. No.: WO2006/123942

PCT Pub. Date: Nov. 23, 2006

(65) Prior Publication Data

US 2009/0126615 A1 May 21, 2009

(30) Foreign Application Priority Data

May 18, 2005 (NZ) ..... 540123

(51) Int. Cl.
*B63B 21/04* (2006.01)
*B63B 21/00* (2006.01)

(52) U.S. Cl. ..... 114/218; 114/230.1

(58) Field of Classification Search ..... 114/218, 114/230.1, 230.2, 230.23, 230.25, 230.26, 114/230.28, 230.3
See application file for complete search history.

(56) References Cited

U.S. PATENT DOCUMENTS

| | | | | |
|---|---|---|---|---|
| 2,555,805 | A * | 6/1951 | Miller | 114/218 |
| 4,270,478 | A * | 6/1981 | Kafka et al. | 114/218 |
| 4,531,470 | A | 7/1985 | Paul | 114/230 |
| 4,890,566 | A | 1/1990 | Morris | 114/218 |
| 5,004,388 | A | 4/1991 | Harris | 410/107 |
| 6,234,101 | B1 | 5/2001 | Czipri | 114/218 |
| 6,588,355 | B1 | 7/2003 | Whitley, II et al. | 114/218 |

FOREIGN PATENT DOCUMENTS

WO 03086854 10/2003

* cited by examiner

*Primary Examiner* — Daniel Venne
(74) *Attorney, Agent, or Firm* — Jacobson Holman PLLC

(57) ABSTRACT

An automatically and remotely operable retractable mooring cleat. The retractable cleat is mountable in a surface, such as the deck, of a marine vessel. A source of motive energy forms part of an actuation mechanism energisable by a user to extend or retract cleat members from the surface. The cleat members each travel along diverging paths as they extend and travel along the same respective paths as they are retracted. The cleat is thereby able to extricate itself from an attached mooring line as it retracts. Multiple retractable cleats may be positioned about a marine vessel, each of which is operable remotely to extend or retract. Single-handed launching of a moored vessel is therefore possible.

32 Claims, 9 Drawing Sheets

RETRACTABLE MOORING CLEAT

BACKGROUND TO THE INVENTION

1. Field of the Invention

This invention relates to a mooring cleat and in particular though not solely to a retractable mooring cleat which is automatically operable to retract in to the deck or some other surface of a boat while at the same time automatically releasing an attached mooring line.

2. Background Art

Mooring cleats (also known as bollards in some countries/situations) are widely used in the marine industry to tie lines (such as ropes or cables) to. Cleats usually have two, but may have more, projecting ends and are fixed to a surface (such as the deck) of a marine vessel. Retractable mooring cleats were developed to provide a "flush" or smooth deck when the cleat is not in use. This is both visually appealing and safer for boat crew. Most existing retractable mooring cleats are manually retractable into the deck or other surface of a boat.

An example of a manually retractable mooring cleat is disclosed in U.S. Pat. No. 5,004,388A wherein a spring biased cleat is telescopically moveable vertically within a hollow housing mounted in the deck of a boat. The cleat is locked in position within the housing by a locking mechanism which is released by a user manually depressing the cleat which then moves to its extended position under the force provided by the spring.

An automatically retractable cleat is disclosed in WO 03/086854. This document discloses various embodiments of retractable cleat including cleats which retract by rotating about a horizontal axis just below the deck surface and automatically vertically retractable cleats. However, before any of the disclosed cleats may be retracted, any attached mooring line or rope must first be manually removed.

U.S. Pat. No. 4,531,470A discloses a mooring line coupler which is not retractable but which is operable to automatically release an attached rope having a preformed loop at its end through which a vertically projecting part of the cleat passes to lock the rope in position. A solenoid pin normally holds the projecting part in the vertical plane. The pin is retractable to allow the projection to swing (under a spring bias) away from its vertical position thereby releasing the rope.

None of the above documents disclose a retractable cleat that, during retraction, is capable of extricating itself from an attached mooring line. It would be an advantage to provide an automatically retractable cleat which also automatically released an attached mooring line as it was retracted or during the retraction process and wherein standard mooring lines could be used.

Accordingly, it is an object of the present invention to provide a retractable cleat which will go at least some way towards meeting the above desiderata or which will at least provide the public with a useful choice.

In a first aspect, the invention consists in a retractable cleat comprising:

a frame having an upper surface, a first member extendable from said upper surface along a first path, a second member extendable from said upper surface along a second path, divergent from the first path, and an actuation mechanism mounted on said frame operable to cause the first and second members to move along the first and second paths respectively to either protrude from the said upper surface or to retract below, or substantially flush with, said upper surface.

Preferably, the movement between the upper surface and the first or second member respectively is a purely sliding action.

Preferably, the movement between the upper surface and the first or second member respectively is a sliding and/or twisting action.

Preferably, the first and second paths are enclosed entirely within the three dimensional volume defined by the first and second members respectively when at their fully extended positions.

Preferably, the cross-section of the first and/or second members are constant along their length, at least along the portion which is able to protrude from the frame.

Alternatively, the first and/or second members are tapered towards their ends which extend from the frame.

Preferably, the first and second members have a circular cross-section.

Alternatively, the first and second members have a substantially square cross-section.

Preferably, the first and second members are substantially straight.

Alternatively, the first and second members are curved.

Preferably, the first and second members are curved in fixed radius arcs.

Preferably, the first and second members are helical and moved along their respective paths by a screwing action.

Preferably, the force applied by the first and second members is greater at the start of retraction and reduces towards the end of retraction.

Preferably, a base plate forms said frame.

Preferably a housing forms said frame.

Preferably, each of the first and second members are each supported within the housing by at least one fixed bushing through which the first or second member respectively is able to slide.

Preferably, the first and second members are each supported within the housing by two fixed bushings that are formed from a compressible material.

Preferably, the bushing or bushings have an opening that matches the cross-sectional shape of the first and second members.

Preferably, the first and second members have lower ends that remain below the upper surface of the housing and upper ends that are extendable above housing's upper surface wherein the first and second members have a stop projecting outward at or near their lower ends and lower bushings on the respective first and second members include a depression shaped to receive the stop when the member is in its fully extended position.

Preferably, the first and second members have lower ends that remain below the upper surface of the housing and upper ends that are extendable above the housing's upper surface, wherein a first driving member is pivotally connected at or near the lower end of the first member and a second driving member is pivotally connected at or near the lower end of the second member and the actuation mechanism includes a source of motive energy connected to drive the first and second driving members to thereby cause the first and second members to move along their respective paths.

Preferably, the first and second driving members each include a rack formation and the source of motive energy is connected to rotate drive wheels, one of which engages with the rack formation on the first driving member and another of which engages with the second driving member.

Preferably, the source of motive energy comprises an electric motor that rotates a worm gear coupled to drive a worm gear wheel that is coupled to rotate the drive wheels.

Preferably, actuating means are provided to manually disengage the source of motive energy from the drive wheels.

Preferably, the actuation mechanism comprises a plurality of interconnected gear wheels between a central drive wheel, that is driven directly by the worm gear wheel, and the rack formations and the actuating means comprise a lever adapted to disengage the central drive wheel from its connection to the worm gear wheel.

Preferably, the central drive wheel and the worm gear wheel are mounted on the same shaft with the worm gear wheel slidable and rotatable on the shaft and the central drive wheel fixed to the shaft so that it is movable axially with the shaft and rotatable thereon, wherein the central drive wheel and the worm gear wheel are engaged together by a dog clutch formed by features on their adjacent side surfaces when the shaft is in a first position and disengaged when the shaft is moved axially to a second position that moves the central drive gear away from the worm gear wheel.

Preferably, biasing means are provided to urge the first and second members away from their fully retracted positions.

Preferably, the biasing means comprise a spring that stores mechanical energy as the first and second members are retracted and is connected to provide a resultant torque to one of the first or second members in a direction to cause extension of the first and second members.

In a second aspect, the invention consists in a retractable cleat comprising:

a housing having an upper surface, at least one first member, the or each first member extendable from the housing's upper surface along a respective first path, at least one second member, the or each second member extendable from an associated first member along a respective second path, and an actuation mechanism operable to cause the or each first member to move along their respective first paths to either protrude from the upper surface or to retract below, or substantially flush with the upper surface and to cause the or each second member to move along their respective second paths to either protrude from or to retract within their associated first member.

Preferably, extension and retraction of a second member occurs while its associated first member is fully extended.

Preferably, each first path is substantially straight and perpendicular to the housing's upper surface.

Preferably, each second path is substantially straight and perpendicular to the first path of its associated first member.

Preferably, the retractable cleat includes one first member and at least two associated second members.

Preferably, the retractable cleat includes two spaced apart first members, each including a single second member extendable therefrom wherein the respective second paths extend in opposite directions.

Preferably, the or each first member comprises a post having an oblong cross-sectional shape viewed in the direction of the first path.

Preferably, a base plate forms the outer surface of the housing.

In a third aspect, the invention consists in a marine vessel including at least one retractable cleat according to the first or second aspects, mounted in a cavity formed in or beneath a surface in the marine vessel.

Preferably, a plurality of retractable cleats are provided within respective cavities beneath or in a surface or surfaces of the marine vessel and the actuation mechanism of each retractable cleat is operable in unison.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

Preferred embodiments of the invention will now be described with reference to the accompanying drawings in which.

DETAILED DESCRIPTION OF THE PREFERRED EMBODIMENT

Figure 1:
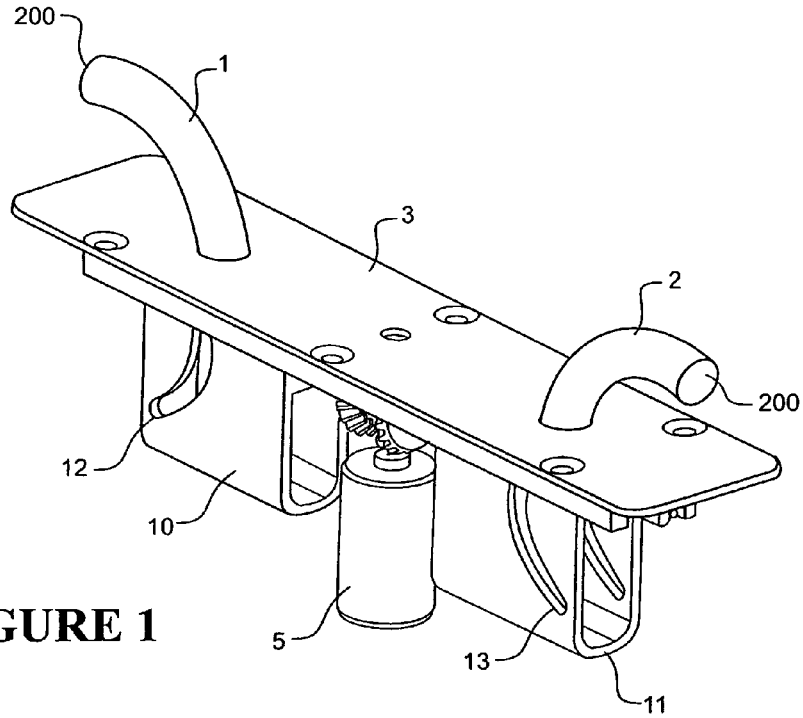
FIG. 1 is a perspective view of a retractable cleat according to a preferred form of a first embodiment of the present invention.

A first preferred embodiment of automatically retractable cleat is shown in FIG. 1. The cleat is formed by first 1 and second 2 members which act as retaining pins or arms or horns around which lines may be tied and protrude through holes formed in a deck or base plate 3. Although only two members 1, 2 are shown, more than two members may be provided, for example three or four members may be provided. Equally, where only two members 1,2 are provided, they need not be diametrically opposed (as shown in FIG. 1) although this is preferred, so long as they are generally divergent. The first 1 and second 2 members may be formed from steel, for example stainless steel. Base plate 3 may be formed from stainless steel or brass for example.

The base plate is substantially planar and adapted to be mounted substantially flush with the deck or another surface of a marine vessel. In some circumstances, it may be desirable for the vessel's surface to form the base plate without the addition of a separate base plate component. In this case, the surface of the vessel would be provided with holes for each of the retractable cleat members to pass through.

Figure 2A:
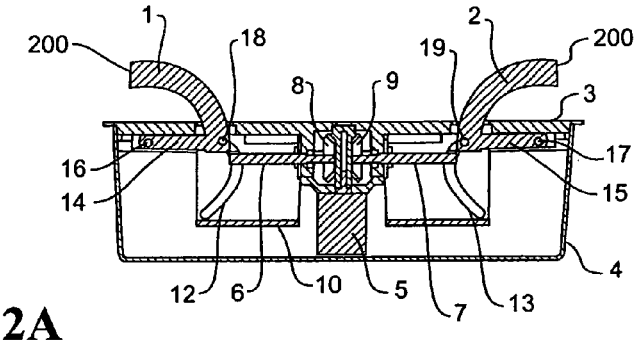
FIG. 2A is a cross-sectional front elevational view of the retractable cleat of FIG. 1 in a fully extended state.
Figure 2B:
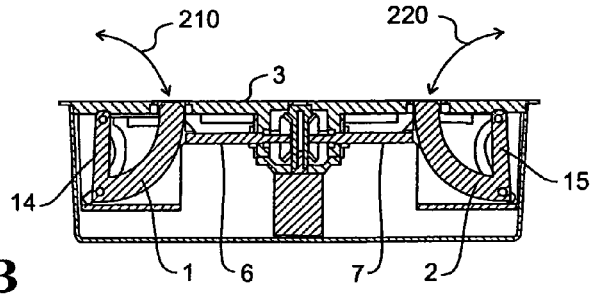
FIG. 2B is a cross-sectional front elevational view of the retractable cleat of FIG. 1 in a fully retracted state.

An actuation mechanism (which will be described below) is provided beneath base plate 3 and the actuation mechanism parts mounted directly or indirectly to the base plate which acts as a frame may be contained within a housing 4 (see FIGS. 2A and 2B). Housing 4 containing the actuation mechanism is therefore designed to be mounted in a suitably sized cavity formed in the deck or other surface of a marine vessel. Where a discrete base plate is not used the housing is used to mount the actuation mechanism. The automatically retractable cleat may be formed in a range of sizes. One size could, for example, be 250 mm long, 50 mm wide by 150 mm deep with a 3 mm thick base plate.

In this first embodiment, members 1 and 2 are cylindrical (having a circular cross-section) although they have both been formed in a curve, more particularly a constant radius arc. In the fully extended state shown in FIGS. 1 and 2A, a rope may be attached to one or preferably both members 1,2, for example by winding in a "figure of 8" pattern around the two members as is well known. The cross-sectional shape of the first and second members need not be circular and could for example be oblong, square, elliptical, hexagonal, octagonal or any other shape so long as the cross-sectional shape does not increase in size or diameter towards the free end (furthest from base plate 3 when extended). In other words, the members should have an unchanging cross-sectional shape or they could be tapered towards their free ends but should not increase in diameter towards the free end.

The actuation mechanism includes an actuator or source of motive energy such as an electric motor 5. The motor's shaft is substantially vertically aligned and a bevelled gear is provided thereon. Two horizontally mounted threaded axles 6 and 7 are rotated by the shaft through respective bevelled gears 8 and 9. Axles 6 and 7 extend along a longitudinal (that is, parallel with the long sides of the cleat) axis of the cleat, substantially parallel to or co-planar with a plane in which the first and second members 1, 2 lie. Driving blocks 10 and 11 are captively mounted beneath base plate 3 but movable along the cleat's longitudinal axis. The driving blocks 10, 11 are moved longitudinally by the rotation of respective axles 6 and 7.

As is most clearly shown in FIG. 1, each driving block has a substantially "U" shaped cross-section with a hollow central portion into which the axles protrude. This may be achieved, for example, by connecting a captive nut to each driving block and providing a matching screw thread on each axle which passes through a respective captive nut. Rotation of the shaft of motor 5 in a first direction causes outward movement of both driving blocks 10 and 11 while rotation of the shaft in the opposite direction causes inward movement of both blocks. Each driving block is provided with a curved channel or slot 12, 13. In the embodiment shown, each driving block includes a pair of channels aligned laterally across the width of the cleat, that is, between the cleat's long sides.

The first 1 and second 2 members each form slightly more than a quarter of an arc of a circle. The lower ends of the first and second members remain below base plate 3 during the full range of movement of the members. Radial members 14, 15 are connected to the lower ends of the first and second members respectively. The radial members 14 and 15 are pivotally coupled beneath base plate 3 about pivot points 16 and 17 respectively.

Lugs or pins 18 and 19 extend laterally from the first and second members respectively into curved channels 12 and 13. Accordingly, movement of driving blocks 10 and 11 outwardly between the position shown in FIG. 2A and the position shown in FIG. 2B will cause lugs 18 and 19 to move downwardly along curved slots 12 and 13 respectively thereby retracting the first 1 and second 2 members so that their outer ends are just beneath or substantially flush with the upper surface of base plate 3. Conversely, movement of driving blocks 10 and 11 inwardly between the position shown in FIG. 2B and the position shown in FIG. 2A will cause lugs 18 and 19 to move upwardly within the slots thereby extending the first and second members into their operative positions as shown in FIG. 1.

It should be noted that slots 12 and 13 do not follow a fixed radius curve and that the motor shaft rotates at a substantially constant speed. The radius of curvature of each slot increases along its length (from the top of the block to the bottom as shown in FIGS. 1, 2A and 2B) so that at the start of retraction the speed at which the first and second members move is less than at the end of retraction. In this way, a greater force is applied to initially move the first and second members which is an advantage when a rope has been tightly wound around the cleat. As a result, the retracting first and second members are more easily able to overcome any large frictional coupling with an attached line or rope.

As the points 16, 17 about which the first and second members rotate is at their centre of curvature, the movement between the base plate and the first and second members respectively is a purely sliding action. Equally, the movement between each member and an attached rope is a purely sliding action with no longitudinal or lateral movement which could otherwise tighten a knot of an attached rope. In effect, each member 1, 2 follows a retraction/extension path 210, 220 which is enclosed entirely within the three dimensional volume 200 defined by that member when at its fully extended position. More particularly, at any position between fully extended and fully retracted, the extended portion of each member will be within the volume 200 defined by the fully extended position of that member.

Figure 3A:
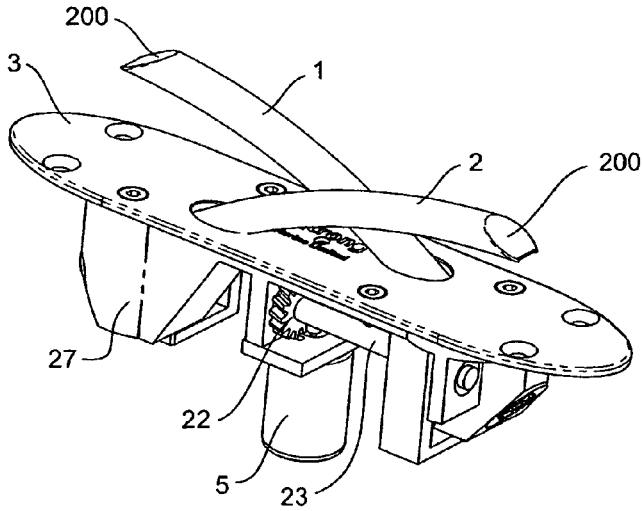
FIG. 3A is a perspective view of a retractable cleat according to a preferred form of a second embodiment of the present invention, with housing not shown for clarity.
Figure 3B:
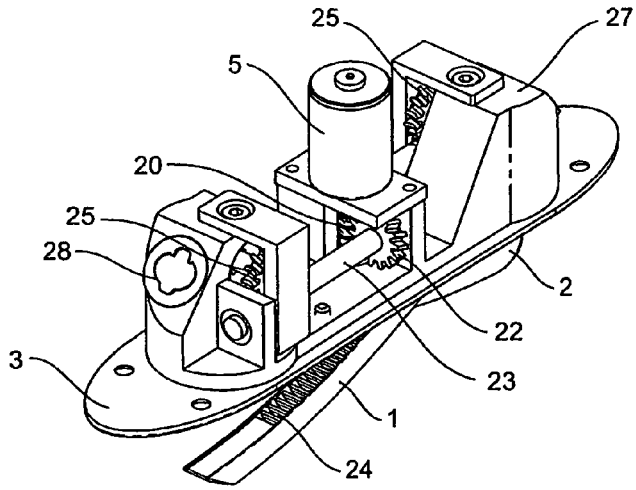
FIG. 3B is a perspective view of the retractable cleat of FIG. 3A upside down.

In a second embodiment of automatically retractable cleat shown in FIGS. 3A and 3B, the first 1 and second 2 members are slightly curved. The motor shaft is provided with a worm or spiral gear 20 which drives a worm gear wheel 22 to rotate axle 23. Axle 23 includes a further worm gear (hidden from view) which drives a further worm wheel 25 acting as a pinion to drive a rack gear 24 (FIG. 3B) on the underside of at least a lower portion of each of the first and second members. Although not shown, a similar worm gear, worm wheel and rack gear are enclosed within housing 27 and also driven by rotation of axle 23 to extend/retract the second member 2.

The first and second members 1, 2 are supported so that they are only free to move along first and second paths respectively which are contained within their respective fully extended volumes. Rotation of motor 5 in a first direction therefore extends both members out of their holes in base plate 3 until they reach the positions shown in FIGS. 3A and 3B. Operation of the motor in the opposite direction retracts both members along their respective paths and allows each member to slip through any attached rope loop or knot until the outer ends of the members are just below or flush with the upper surface of the base plate. In order to ensure that the first and second members do not rotate about their longitudinal axes, a guide bushing 28 may be provided on the housing having a central orifice with a shape matching the cross-sectional shape of at least a bottom portion of the first and second members. The shape is chosen so that relative rotation between the bushing and first or second member is not possible.

Figure 4A:
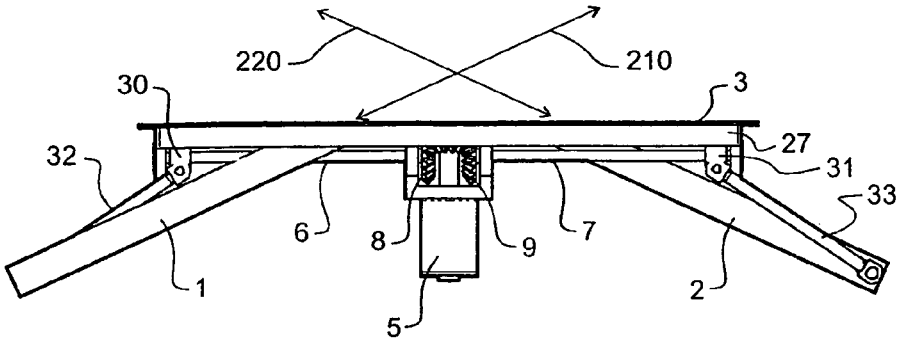
FIG. 4A is a front elevational view of a retractable cleat according to a preferred form of a third embodiment of the present invention in a fully retracted position.
Figure 4B:
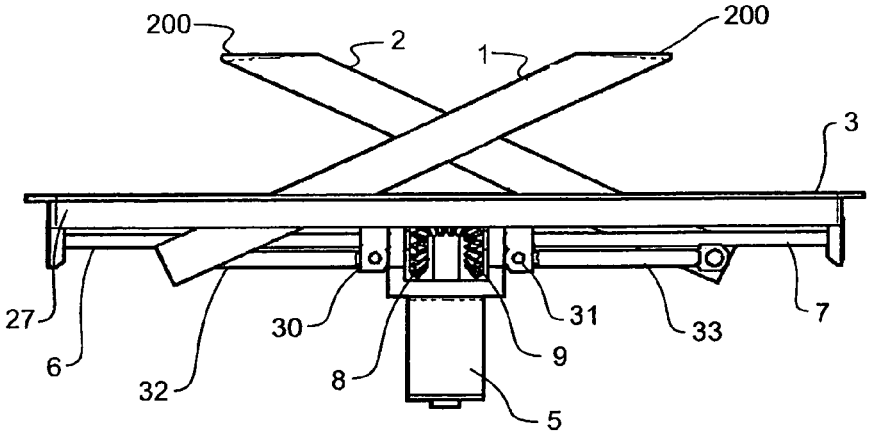
FIG. 4B is a front elevational view of the retractable cleat of FIG. 4A in an extended position.
Figure 4C:
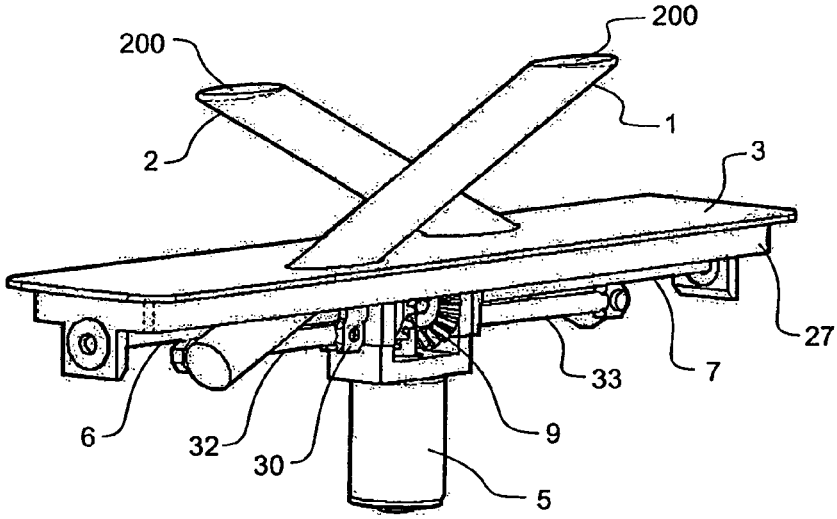
FIG. 4C is a perspective view of the retractable cleat of FIG. 4A in an extended position.
Figure 5A:
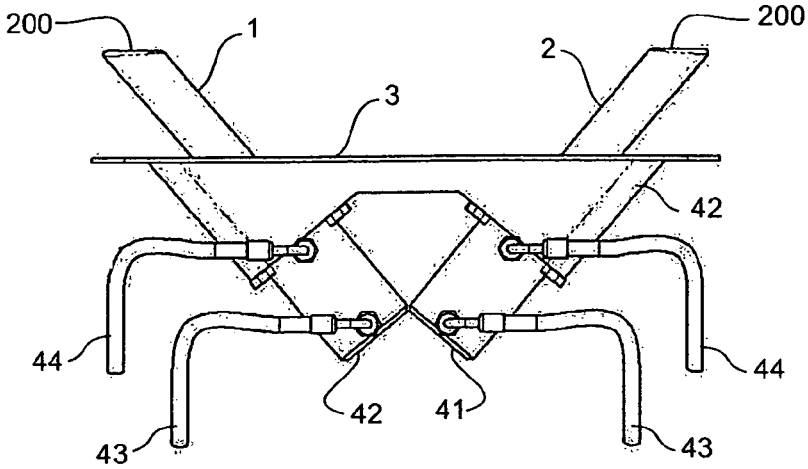
FIG. 5A is a front elevational view of a retractable cleat according to a preferred form of a fourth embodiment of the present invention in a fully extended position.
Figure 5B:
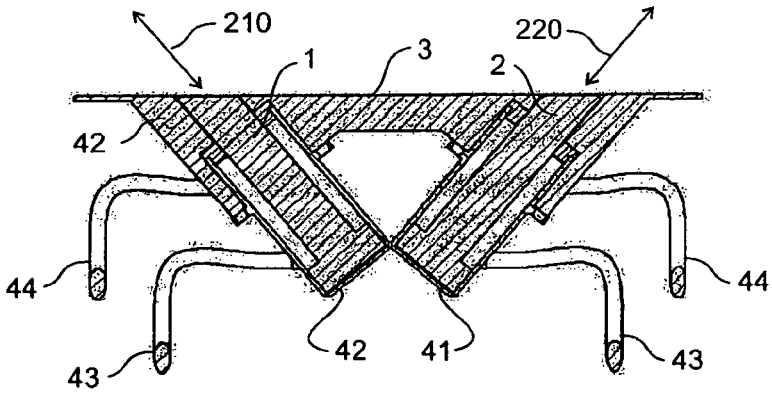
FIG. 5B is a cross-sectional front elevational view of the retractable cleat of FIG. 5A in a fully retracted position.
Figure 5C:
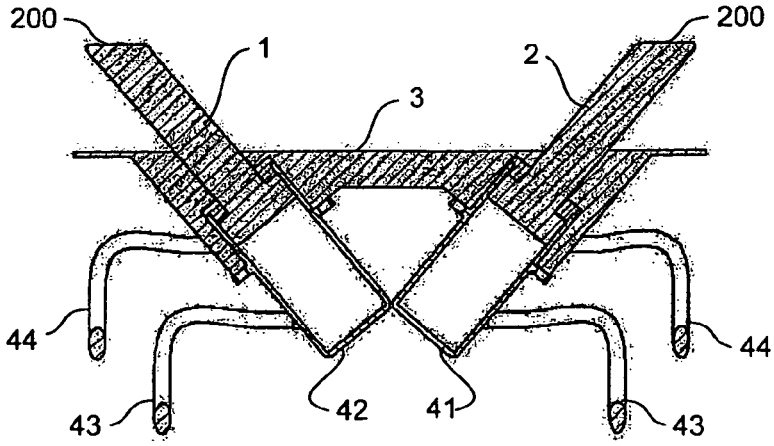
FIG. 5C is a cross-sectional front elevational view of the retractable cleat of FIG. 5A in a fully extended position.
Figure 5D:
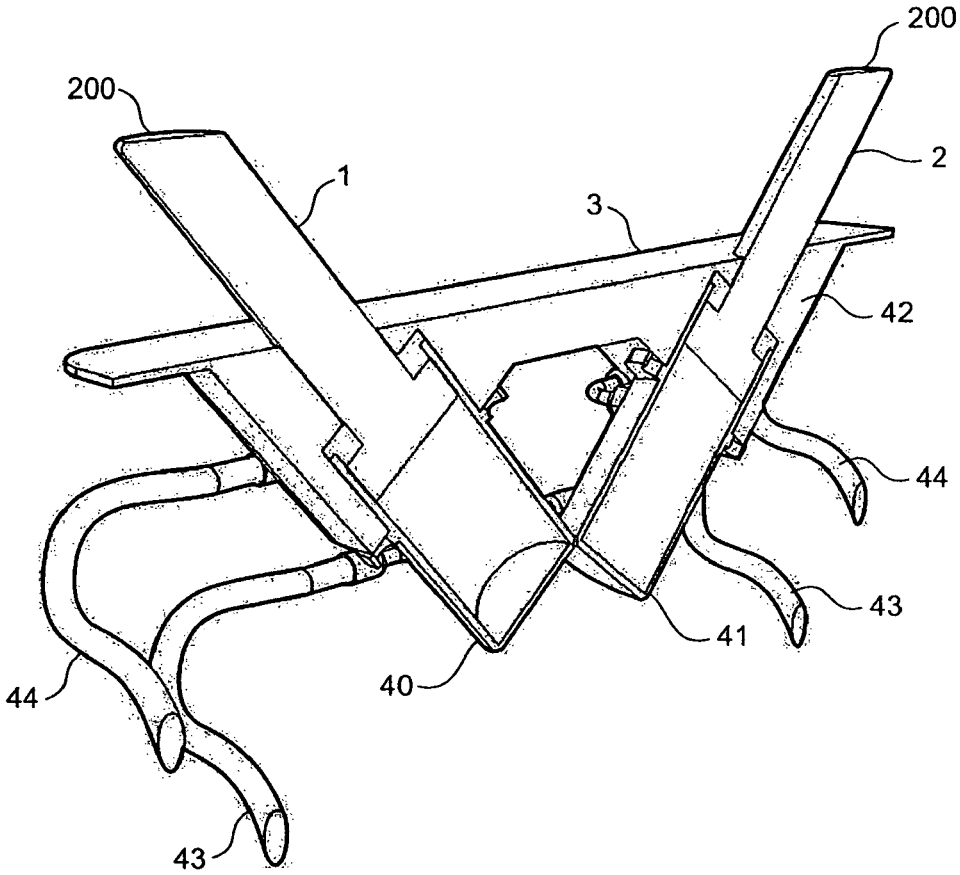
FIG. 5D is a cross-sectional perspective view of the retractable cleat of FIG. 5A in a fully extended position.

A third embodiment of automatically retractable cleat is shown in FIGS. 4A, 4B and 4C. In this embodiment the first 1 and second 2 members are straight and extend/retract along straight paths 210, 220. Members 1 and 2 could alternatively be curved as shown in FIGS. 3A and 3B.

As in each of the other embodiments, during retraction/extension, each point on the side surface of each member 1, 2 travels along (or within if the member is tapered) the surface of a volume defined by that member when in its fully extended position. In this way, during retraction, there is only a sliding action between the member and an attached rope and no outward (from the centre of the base plate) lateral or longitudinal movement which could otherwise tighten the rope about the cleat. In the case of a tapered member, retraction will effectively cause an inward longitudinal and/or lateral displacement of the member at any fixed point along its path which will act to loosen a tightly attached rope or line.

In this third embodiment, the actuation mechanism includes a motor 5 mounted to a housing 27 with the motor's shaft again (as in the first embodiment) driving bevelled gears 8 and 9. Bevelled gears 8 and 9 drive horizontally mounted shafts 6 and 7 each of which have a thread formed along their outer surface. Link carriages 30 and 31 are mounted on shafts 6 and 7 respectively and each include an inner threaded orifice so that, when carriage 30 or 31 is fixed against rotation, rotation of shaft 6 or 7 will cause carriage 30 or 31 to move laterally along shaft 6 or 7. The direction of the threads provided on shafts 6 and 7 are arranged oppositely so that rotation of the motor shaft in a first direction causes carriages 30 and 31 to move towards each other while rotation of the motor shaft in the opposite direction causes the carriages to move away from each other.

Link member 32 is connected between a point near the end of member 1 and link carriage 30 via pivotal connections at each end. Similarly, link member 33 has pivotal connections to member 2 and link carriage 31. Link members 32 and 33 ensure that link carriages 30 and 31 are unable to rotate about shafts 6 and 7. Accordingly, rotation of the motor shaft in a first direction draws the link carriages towards each other so that both members 1 and 2 travel out of the base 3 towards their fully extended positions. Rotation of the motor shaft in the opposite direction retracts the members.

The third embodiment could be modified to allow an increased range of movement of carriages 30 and 31. This could be achieved by extending each shaft 6, 7 to substantially the full length (or a fraction between ½ and full length) of base plate 3 and positioning the two shafts parallel to one another, offset to either side of a central line of the base plate. To rotate the full length threaded shafts, half length drive shafts could be provided between the two threaded shafts, connected to the motor shaft by bevelled gears for example, both extending away from the motor in opposite directions in the same way that the threaded shafts 6 and 7 are arranged in FIGS. 4A to 4C. The distal ends of the drive shafts could then carry gear wheels connected to respective matching gear wheels on the threaded shafts.

A fourth embodiment of automatically retractable cleat is shown in FIGS. 5A to 5D. In this embodiment, as the illustrated version of the third embodiment, the first and second members are both straight although they are not crossed but are rather juxtaposed in a "v" shape formation. Although the actuation mechanism could be similar to that shown in FIGS. 3A and 3B, a hydraulic or pneumatic actuation mechanism is illustrated.

First and second members 1 and 2 are provided by retention pins retained respectively within hydraulic cylinders 40 and 41. A housing 42 is formed with base plate 3 on its upper surface including holes for members 1 and 2 to extend through. Housing 42 includes receiving holes which receive cylinders 40 and 41 and which are aligned with their respective holes in base plate 3. As in the other embodiments, the upper ends 200 of members 1 and 2 are angled or bevelled so that when fully retracted they are level with the upper surface of base plate 3 and substantially fills the hole in the base plate to present a substantially continuous base plate surface.

Pressure hoses 43 and 44 are connected to a source of pressurised fluid so that when pressurised fluid is provided to hoses 43 the cleat is extended as members 1 and 2 move towards their fully extended positions. Removal of pressure from hoses 43 and application of pressurised fluid to hoses 44 causes retraction of members 1 and 2 towards their fully retracted positions within housing 42.

Figure 6:
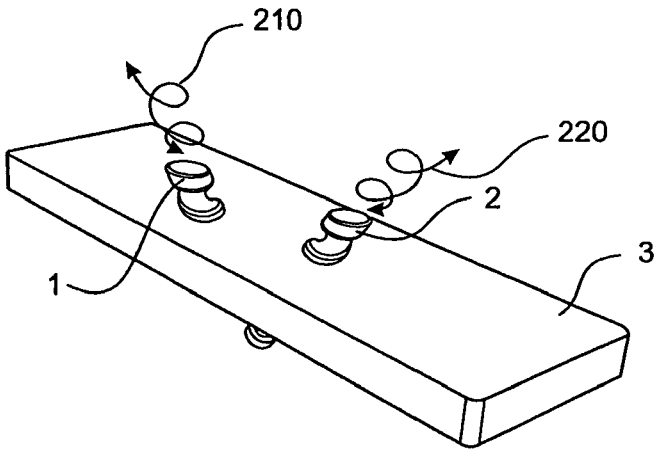
FIG. 6 is a perspective view of a retractable cleat according to a preferred form of a fifth embodiment of the present invention in an extended position.

A fifth embodiment of automatically retractable cleat is shown in FIG. 6. In this embodiment, members 1 and 2 are each spirally or helically formed. The actuation mechanism is omitted from FIG. 6 however one skilled in the art would understand that the members 1, 2 in this embodiment should be driven so that rotation thereof in a first direction will effect retraction and rotation in the opposite direction will effect extension. Preferably the first and second members are mounted so that they are incapable of purely linear movement along their length and this may be achieved by providing the openings in the base plate 3 (through which the first and second members extend/retract) with a complementary thread to the members' spiral/helix thread. Actuation means such as an electric motor could then be coupled to rotate both members along paths 210, 220 and therefore selectively extend or retract them.

During extension and retraction of the first and second members in this embodiment, movement between the base plate 3 and the members is effectively a combination of rotation and a sliding movement. There is no outward lateral or longitudinal movement of the members which might otherwise tighten a loop or knot tied about the cleat during retraction of the cleat. Furthermore, the spiral form of the members provides a spiral groove useful in providing purchase to a rope or line. However, during retraction of the members, because the members are not purely linearly retracted below base plate 3, an attached line can not become caught between a member 1, 2 and base plate 3.

Figure 7A:
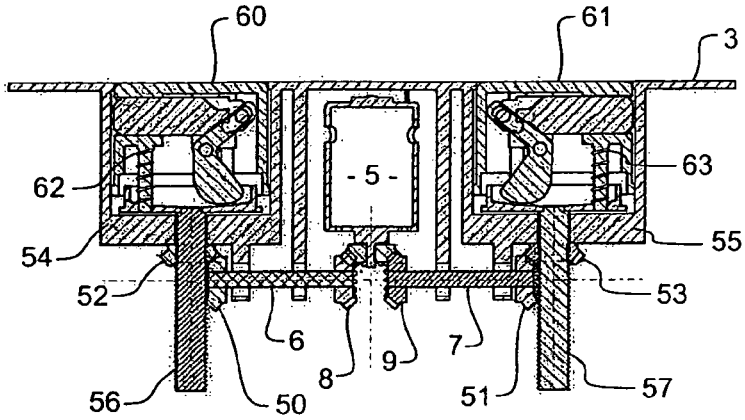
FIG. 7A is a cross-sectional front elevational view of a retractable cleat according to a preferred form of a sixth embodiment of the present invention in a fully retracted position.
Figure 7B:
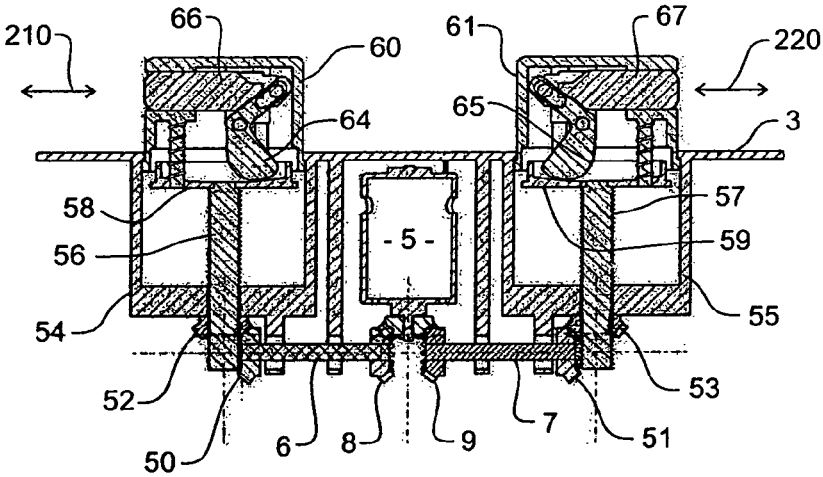
FIG. 7B is a cross-sectional front elevational view of the retractable cleat of FIG. 7A in a partially extended position.
Figure 7C:
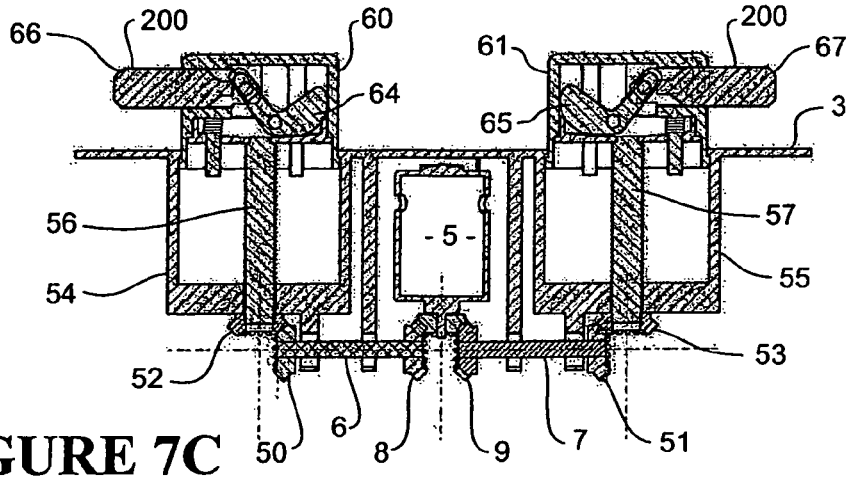
FIG. 7C is a cross-sectional front elevational view of the retractable cleat of FIG. 7A in a fully extended position.

A sixth embodiment of automatically retractable cleat is shown in FIGS. 7A to 7C. In this embodiment, an electric motor 5 forms part of and drives an actuation mechanism. Similar to the first and third embodiments, the actuation mechanism includes primary bevelled gears 8 and 9 driven by a gear on the motor's shaft. Primary bevelled gears 8 and 9 are fixed to the ends of respective horizontally mounted shafts 6 and 7 that rotate with the motor shaft. Secondary bevelled gears 50 and 51 are fixed to the ends of shafts 6 and 7 furthest from the motor so that they also rotate with rotation of the motor shaft. Final, internally threaded bevelled gears 52 and 53 are rotatable by gears 50 and 51 respectively but are fixed in position beneath housing chambers 54 and 55 formed beneath base plate 3.

Final bevelled gears 52 and 53 are mounted upon threaded shafts 56 and 57 which are fixed at their upper ends to spring plates 58 and 59 respectively so as to be non-rotatable. Final bevelled gears 52 and 53 are driven by secondary bevelled gears 50 and 51 respectively so that rotation of the motor shaft in a first direction causes final bevelled gears 52 and 53 to rotate to thereby drive both threaded shafts 56 and 57 and thereby spring plates 58 and 59 upwards and rotation of the motor shaft in the opposite direction causes threaded shafts 56 and 57 and spring plates 58 and 59 to both be driven downwards.

Starting from the fully retracted position shown in FIG. 7A, movement upwards of spring plates 58 and 59 causes bollard members 60 and 61 to raise from their retracted positions within the housing, flush with the base plate 3. Each bollard member 60, 61 moves along a respective first path which is substantially perpendicular to the base plate 3. When spring plates 58 and 59 have reached the positions as shown in FIG. 7B the bollard members 60 and 61 are fully extended and can move no further due to an extending lip on their lower extremities engaging under base plate 3. Further movement of threaded shafts 56 and 57 and spring plates 58 and 59 upwards therefore causes compression of compression springs 62 and 63. It will also be noted that the upper surfaces of spring plates 58 and 59 are slightly curved or dished to provide a camming surfaces which interact with actuation cams 64 and 65 respectively.

Actuating cams 64 and 65 include a lower lobe with a camming surface and an upper arm. The actuating cams are free to rotate about central pivot points and their upper arms include slots in which lugs connected to respective retention pins 66 and 67 are positioned. Retention pins 66 and 67 are mounted for horizontal movement paths 210, 220 and are wholly housed within a respective bollard member. When viewed from above, bollard members 60 and 61 may be oval, for example elliptical in cross-section to accommodate the length of retention pin while minimising the width of base plate and housing required.

Further upwards movement of threaded shafts 56 and 57 from the position shown in FIG. 7B, in addition to causing compression of compression springs 62 and 63, causes rotation of actuation cams 64 (anti-clockwise) and 65 (clockwise) about their central pivot points. Rotation of the actuation cams also causes retention pins 66 and 67 to extend from within bollard members 60 and 61 respectively until the retention pins are fully extended as shown in FIG. 7C and motor 5 is stopped. Movement of each retention pin 66, 67 is along a respective second path 210, 220 substantially perpendicular to the first path of its associated bollard member. It will be noted that extension of the retention pins 66 and 67 only occurs once the bollard members 60 and 61 are fully extended.

Retraction of the cleat according to this embodiment is initiated by driving motor 5 in the opposite direction, assisted by the energy stored within compression springs 62 and 63. Before bollard members 60 and 61 begin to retract, retention pins 66 and 67 are fully retracted within their associated bollard member. Once the retention pins are retracted the bollard members 60 and 61 begin to retract within the housing. In this way, an attached rope or line wound around the extended cleat will not interfere with retraction of the cleat but will simply slip from the cleat as it retracts into the deck of a boat.

Although not illustrated, an alternative preferred embodiment to that shown in FIGS. 7A to 7C is envisaged in which a single bollard member 60 or 61 is raisable substantially perpendicularly to a base plate of a housing mounted in the deck of a boat. The single bollard member would include more than one, preferably two retention pins within it. The retraction pin(s) would be extendable from the bollard member, substantially perpendicular to its path of movement, in opposite directions. When fully extended, the retractable cleat or bollard of this embodiment could have a "t", cross or "T" shape.

A retractable cleat according to a seventh embodiment of the invention will now be described with reference to FIGS. 8A to 8E. Where possible, the same reference numerals have been used to denote similar features to those in the drawings figures illustrating the preceding embodiments.

Figure 8A:
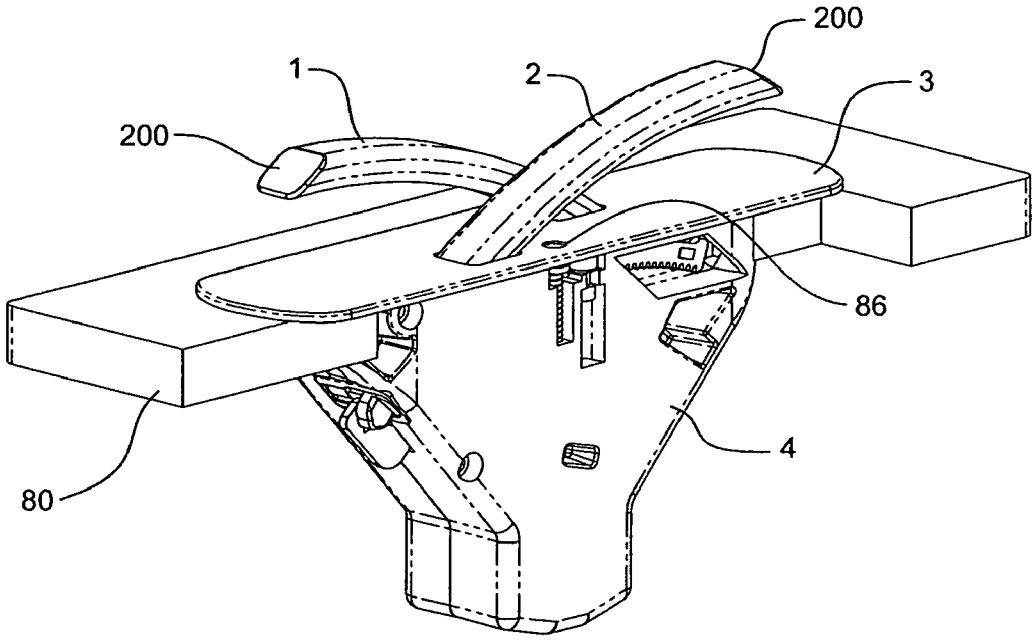
FIG. 8A is perspective view from above of a retractable cleat according to a preferred form of a seventh embodiment of the present invention in an extended position.

In FIG. 8A, the retractable cleat is shown in its fully extended position with first 1 and second 2 members protruding through a base plate 3 that is inset into the deck 80 of a vessel. Note that part of deck 80 has been shown removed for clarity. A housing 4 beneath the base plate supports and protects the actuation mechanism that causes extension and retraction of members 1 and 2. Preferably members 1 and 2 are formed from a high strength material such as a steel duplex alloy (that is, an austenitic/ferritic alloy). Housing 4 may be die cast from marine aluminium. A power failure override (PFO) button 86 is provided in the base plate and its function will be described below.

Figure 8B:
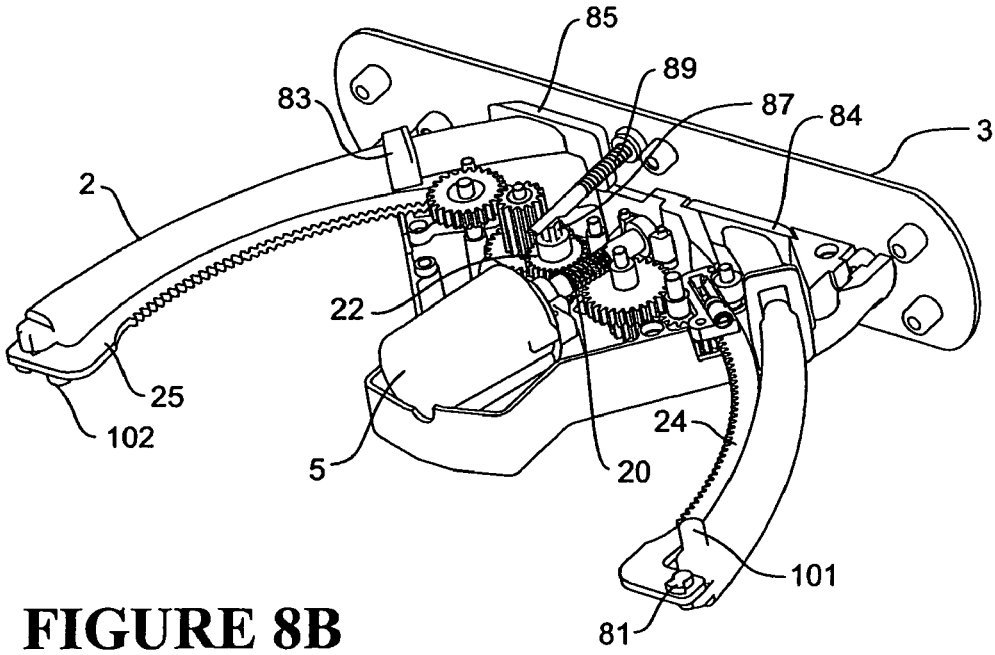
FIG. 8B is a perspective view from below of the retractable cleat of FIG. 8A in a fully retracted position with part of the housing removed.

In FIG. 8B, one part of the housing is shown removed to reveal the inner workings of the actuation mechanism. Members 1 and 2 are fully retracted so that their upper ends 200 are flush with base plate 3. The lower ends of members 1 and 2 extend outside of housing 4 but extend longitudinally only so far as the ends of base plate 3. It can also be seen that members 1 and 2 are curved and have a substantially square shaped cross-section. The lower end of member 1 is provided with a laterally extending pin 81 to which a curved rack member 24 is pivotally connected. Member 2 is also provided with a lower laterally extending pin (hidden from view) to which rack 25 is pivotally connected. Retraction and extension of members 1 and 2 is effected by pinions within the actuation mechanism (including motor 5 and described further below) engaging with teeth on the underside of the rack members 24, 25.

Each member 1,2 is supported within housing 4 at two positions along its length. The support positions are provided by guide bushings 82, 84 for member 1 and bushings 83, 85 for member 2. The bushings have central passages shaped to conform to the cross-sectional shape of the cleat members. Upper bushings 84 and 85 also provide a sealing function to limit or avoid ingress of water to housing 4. Each lower bushing 82, 83 is seated within a cavity formed in the housing wall above a slot through which rack member 24 or 25 travels.

Bushings 82 and 83 therefore isolate the respective members 1, 2 from the housing wall. As can be seen in FIG. 3B, the underside of the lower bushings 82 and 83 are provided with a shaped depression adapted to receive a similarly shaped projection 101 or 102 extending outwardly near the lower ends of rack members 24 and 25 respectively. When members 1 and 2 are fully extended, projections 101 and 102 seat within the respective depressions in bushings 82 and 83 to cause a stop to upward movement of members 1 and 2 so that the motor will stall thus signalling that motor power should be cut.

The bushings are preferably formed from a plastics material that is compressible under a large compression force and has a low coefficient of frictional. For example, the bushings could be formed from PTFE-filled Acetal copolymer such as that sold under the trade name Kepital® FL-2020 by Korea Engineering Plastics Co., Ltd. Preferably the compressibility or elasticity of bushings 83 and 85 is such that when a side-load of a predetermined value is applied to members 1 and 2, the bushings compress sufficiently to allow members 1 and 2 to contact a part of housing 4. In this way, when a sufficiently large side load, say above around 1000N is applied to the retractable members 1 and 2 by a mooring line, that force is transferred to the housing by the members as they pivot about their holes in base plate 3. In this way, the cleat is able to efficiently transfer forces from the point of overlap of the first and second members (which is the position that mooring lines will ordinarily sit) through to the housing and thence on to the structure of the vessel. It is anticipated that a 200 mm long version of the retractable cleat according to this embodiment could withstand a peak side force of around 40,000N.

With reference now to FIGS. 8C to 8F, it can be seen that motor 5 is fixed in the base of housing 4 and is angled away from the vertical in an effort to conserve space within the housing. The output shaft of motor 5 has a worm gear 20 that mates with a complementary worm gear wheel 22. Worm gear wheel 22 is rotatable about a shaft 87 onto which a central drive spur gear 88 (see FIG. 8F) is also rotationally mounted. Rotation of worm gear wheel 22 also causes rotation, in the same direction, of central drive spur gear 88 via, for example, a dog clutch arrangement between adjacent faces of the two gears. The dog clutch arrangement is not visible in the drawings but, as is well known, a dog clutch comprises interlocking or mating projections on the adjacent surfaces of the two gears. Other equivalent mechanisms may be used in place of a dog clutch to cause gears 22 and 88 to rotate together.

The actuation mechanism also includes a series of engaged gear wheels between the central drive spur gear 88 and rack members 24 and 25. Gear wheel 96 and idler gear 92 are both driven directly by central spur gear 88. Idler gear 92 is provided to drive gear wheel 93 and to ensure that it rotates in the opposite direction to gear wheel 96. Gear wheel 93 is rotatably mounted onto a shaft that also carries a further smaller gear wheel 94. Gear wheel 94 engages with a further gear wheel 95. Gear wheel 95 is rotatably mounted on a shaft with a pinion (not shown) that is engaged with the teeth formed in rack 25. A similar arrangement exists between gear 96 and pinion 97 that engages with the teeth of rack 24. Note that the small gear mounted on and rotatable with gear 96 is hidden from view.

Note that the rack formations are kept in alignment by guides 99 and 100 that may each include, for example, two axially separated discs that sit either side of a rack member as it moves on its path past its respective pinion. The enlarged head has a width greater than the distance between the guide 99 or 100 and the corresponding pinion gear 97. In this way, when members 1 and 2 reach their fully retracted positions, the head ends of the rack formations will stop their travel as the head ends are blocked from entering into the space between guide and pinion. This will stall the motor 5 and provide a signal that power should be cut off to the motor. It can also be seen that the two rack members 25 and 25 are offset laterally slightly to avoid collision when the cleat is fully extended. Rack members 24 and 25 are each provided with an enlarged head at their upper ends.

Accordingly, rotation of the motor shaft in a first direction (clockwise) causes retraction of the first and second members as the rack members are moved outwards and downwards. Rotation of the motor in the opposite direction (ant-clockwise) causes extension of the first and second members as the rack members are drawn upwards and inwards.

The dog clutch between gear wheels 22 and 88 may be disengaged so that rotation of worm gear 22 is not affected by and, in turn does not affect, rotation of central drive spur gear 88. This disengagement is beneficial in order to allow the cleat to be manually actuated in the case of, for example, power failure (that is, a flat battery). Ordinarily it will not be crucial to allow the cleat to be retractable in the case of power failure (it being possible, but less convenient, for the user to simply untie any attached mooring lines) but it is important to allow the cleat to be extended in such situations so that the vessel can then be safely moored.

As previously mentioned, PFO button 86 is mounted in a the housing through a hole formed in the base plate 3. Ordinarily, the upper end of PFO button 86 is flush with or slightly below the surface of base plate 3. The PFO button has a lower rod portion extending into the housing and aligned to intersect with the axis of shaft 87. The lower rod portion may be generally cylindrical but is provided with an angled cut away section so that the lower rod portion can extend past the end of shaft 87. When the PFO button is depressed by a user, against the biasing force of spring 89, the angled cut away portion of the rod acts as a ramp that engages with the end of the shaft and provides an axially directed force on the shaft as the button is depressed.

The shaft is mounted so as to be movable axially although it is preferably spring biased towards the rod portion of PFO button 86. Central drive spur gear 88 is rotatable about shaft 87 but is not slidable on the shaft (by for example, providing a shoulder on one side and a circlip on the other of the gear). However, worm gear wheel 22 is slidable on the shaft but means are provided to maintain the worm gear in engagement with the worm wheel 20. Such means may comprise a projection within the housing (preferably formed from a compliant material such as a plastics) that contacts the upper surface of worm gear wheel 22 so that it is restrained if it attempts to move axially with the shaft. Accordingly, depression of PFO button 86 causes shaft 87 to move axially and to lift the dog clutch element of central drive spur gear 88 out of engagement with the complementary dog clutch arrangement on worm gear wheel 22.

Once gears 88 and 22 are out of engagement, the first 1 and second 2 members may freely be retracted or extended in unison by a user. As the upper surface of the first and second members may not easily be accessible to a user (as they are most likely flush with the base plate), biasing means may be provided to urge the first and second member away from their fully retracted positions. This biasing means could, for example, be provided by a clock spring connected between the housing and one of the gear wheels in the actuation mechanism. The spring would coiled up as members 1 and 2 are retracted and the stored mechanical energy would be released, rotating the connected gear wheel once gear wheels 22 and 88 are disengaged. As is well known, when the motor is turned off, the biasing force provided by the spring would not be able to rotate the gear wheels to extend members 1 and 2 when gears 22 and 88 are engaged as worm gear wheel 22 is unable to drive worm wheel 20 on the motor's shaft.

Figure 8C:
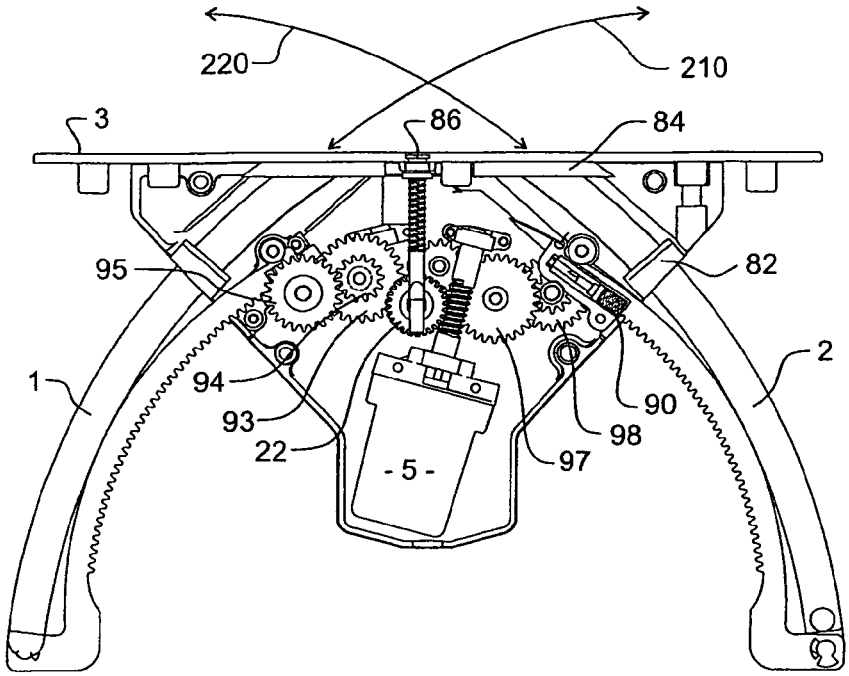
FIG. 8C is a cross-sectional front elevation through the retractable cleat of FIG. 8A in a fully retracted position.
Figure 8D:
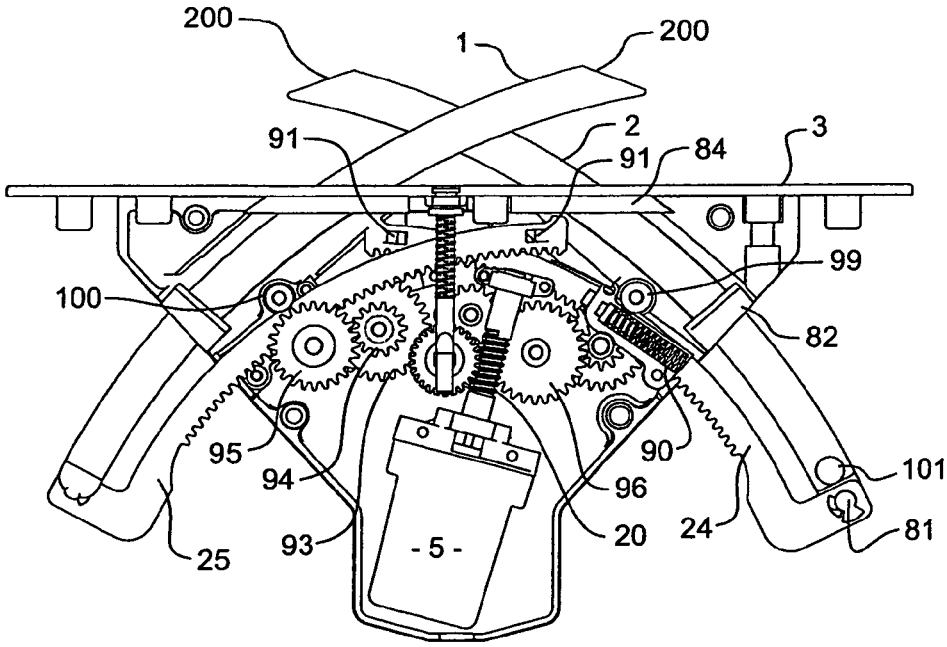
FIG. 8D is a cross-sectional front elevation through the retractable cleat of FIG. 8A in a partially extended position.
Figure 8E:
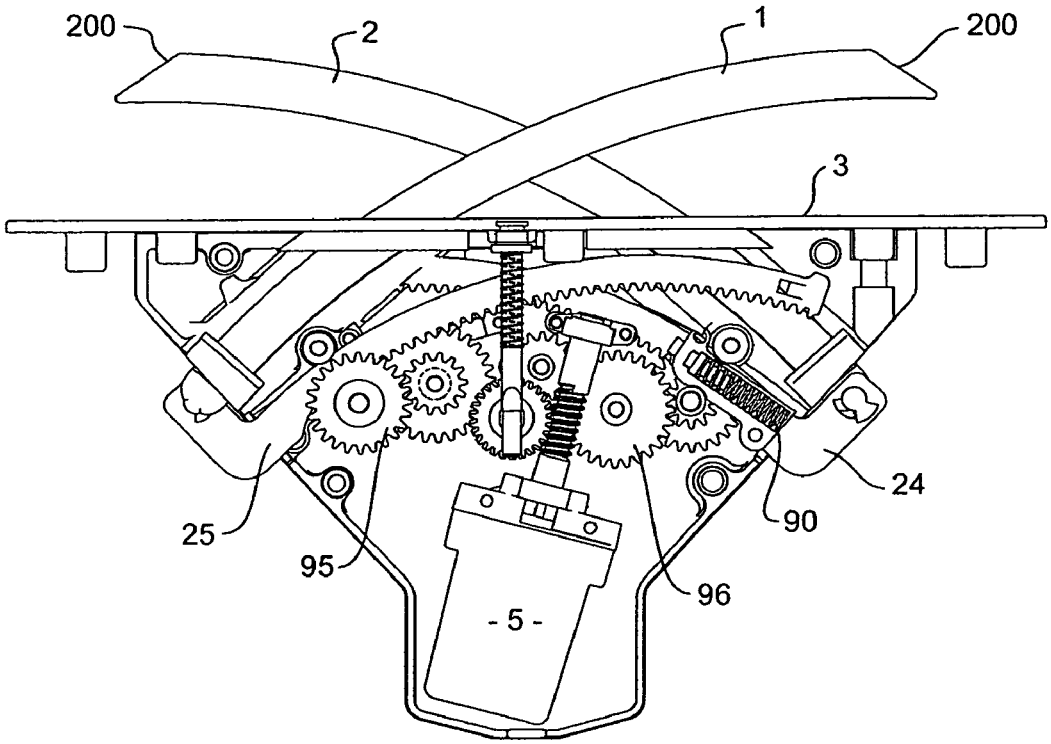
FIG. 8E is a cross-sectional front elevation through the retractable cleat of FIG. 8A in a fully extended position.
Figure 8F:
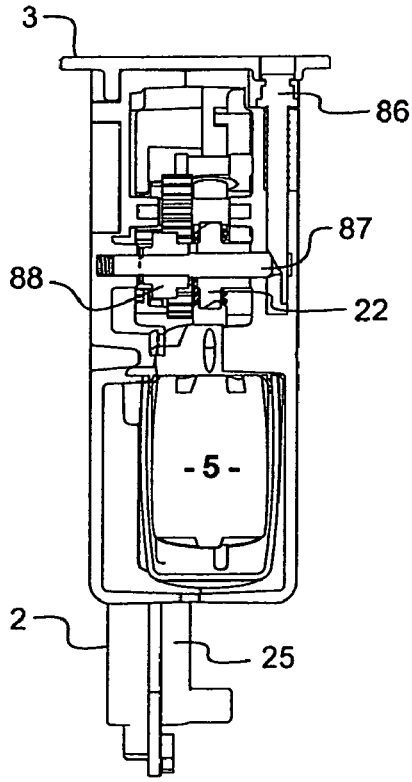
FIG. 8F is an end elevational cross-sectional view of the retractable cleat of FIG. 8A with the power failure button shown in a depressed state and the cleat members in a retracted position.

Alternatively, the means for biasing the first 1 and second 2 members towards an extended position could be as shown in FIGS. 8C to 8E wherein compression spring 90 is provided. Spring 90 is compressed by contact with projection 91 at the end of rack member 25. As before, when members 1 and 2 are retracted to the point where projection 91 contacts the spring, further retraction will compress spring 90. Mechanical energy stored in spring 90 will be released as soon as gear wheels 22 and 88 are disengaged resulting in a slight extension of members 1 and 2 above base plate 3 so that a user may easily grasp their ends. Once members 1 and 2 have been moved to a desirable position so that a mooring line can be attached thereto, the PFO button 86 may be released. Once members 1 and 2 are released, spring 89 will raise the button so that the ramp segment of the lower rod part of PFO button 86 is disengaged from the end of shaft 87. Shaft 87 may then return, under bias from a compression spring, to its normal position with the dog clutch between gears 22 and 88 once again engaged so that the members are once again locked in position.

In any of the preferred embodiments described above, an electrical power source such as the marine vessel's battery may supply power to operate the actuation mechanism such as motor 5 via a user input device such as a switch. The switch could alternatively be an input device to an electronic controller such as a microprocessor and the energisation of the actuation mechanism could be software controlled.

It should be noted that motive power provided to the first and second members 1, 2 in each of the embodiments described above could be supplied by any suitable driving or actuation means and is not limited to an electric motor. For example, the actuation mechanisms particularly in the purely linear movement embodiments could be based around an electric solenoid or a linear actuator driven by the vessel's hydraulic or pneumatic system. Furthermore, if an electric motor were included then it could be a variable speed motor able to give a higher speed initial "jolt" during retraction of the first and second members to overcome friction of an attached line. It should also be noted that a user need not fully extend the retractable cleat.

Extension and retraction of the cleat's pins could be controlled by a toggle switch that must be depressed in a first direction to extend the pins and a second direction to retract the pins. When the user releases the button the pins may remain in their present position. Alternatively, the switch could for example be provided as a locking toggle switch so that the user could activate the switch to retract the cleat and the cleat would then operate to retract the pins even if the user were to remove finger contact with the switch.

In case of power failure, it would be desirable that the cleat could be manually activated at least into its extended position from their retracted position. Desirably, the cleat would also be manually retractable from its extended position but this is not seen as crucial. The seventh embodiment described with reference to FIGS. 8A to 8E includes such a feature but any of the embodiments of cleat described herein could be "spring loaded" by incorporating springs which bias the first and second members towards their extended position. Normal power actuation of the cleat to extend the first and second members would therefore be aided by the spring bias whereas retraction of the pins or lugs would store energy in the spring. In a preferred embodiment, an actuation switch or button would be provided in the base plate of each cleat which would unlatch the pins or lugs from the power driving mechanism to allow them to move to their fully extended positions using energy stored within the spring(s). The first and second members may then be locked in position. Manual retraction of the first and second members could be achieved by providing a socket in the base plate into which a key (such as an Allen key or similar) could be received wherein the socket is connected to the motor's shaft so that rotation of the socket by the key in a certain direction rotates the shaft causing the first and second members to be retracted.

It is often desirable to include multiple automatically retractable cleats in a single marine vessel. For example, one automatically retractable cleat could be positioned on either side of a vessel, fore and aft for a total of four cleats. This would enable the vessel to be secured in a birth at a marina for example by four ropes. In such a case, each retractable cleat would be operated in unison so that all cleats could simultaneously be retracted upon a user command such as pressing a button or switch. All four ropes would then simultaneously be released as the cleats were retracted without the operator needing to physically attend to any of the cleats. The present invention therefore advantageously enables a skipper to single-handedly launch a vessel while maintaining control at all times.

A further advantage of the retractable cleat according to preferred forms of the present invention is safety. Often, a helmsman will want to launch a boat when the tide and/or waves are buffeting the boat. If the mooring lines on the side of the boat facing the wind or waves were to be released just as a large wave or gust of wind impacted the boat then the boat could be propelled into a wharf or other vessel. The retractable cleat according to the present invention is driven by a motor having a finite maximum output torque. The retractable cleat is preferably driven by a permanent magnet DC electric motor having a nominal power output of around 10 W and a limited output torque.

Accordingly, if a user activates the cleat to retract then the motor will only do so if the load on the cleat (caused by tension in the mooring line and friction between the line and the retaining pins) is below a threshold value. From experimentation, a retractable cleat of approximately 200 mm length will release mooring lines with less than around 250N of tension force applied. Higher tension forces will result in the motor stalling and the mooring line safely remaining secured to the cleat. In fact, continued depression by a user of a button for retracting the cleat will have no effect whilst the mooring line tension is above the threshold value and retraction will only commence once the tension safely drops below the threshold. In situations where multiple (for example four) cleats are operated in parallel by a single switch, cleats that are under no load or loads that are less than the threshold load will be retracted (and thereby release their associated mooring lines) before cleats that are currently experiencing a load above the threshold value. This provides greater control over vessel departure from a marina berth and improved safety.

A further safety feature is the use of a worm gear and worm wheel to move the first and second members. As is well known, it is not possible for the worm wheel to drive the worm gear and so once the cleat is extended, it will not retract until a user activates the motor to drive the worm gear to do so. Finally, because the retractable cleat according to at least some embodiments of the present invention (for example, embodiment 7 illustrated in FIGS. 8A to 8E) presents a sealed upper surface, there is no need to run drain lines from the housing.

The invention claimed is:

1. A retractable mooring cleat comprising:

a frame having an upper surface, a first member extendable from said upper surface along a first path, a second member extendable from said upper surface along a second path, divergent from the first path, and an actuation mechanism mounted on said frame operable to cause the first and second members to move along the first and second paths respectively between a fully extended position where the first and second members protrude from said upper surface and a fully retracted position where the first and second members are substantially flush with or below, said upper surface, the first and second paths being enclosed entirely within a three-dimensional volume defined by the first and second members respectively when at their fully extended positions and movement between the upper surface and the first or second member respectively is a purely sliding action.

2. The retractable mooring cleat as claimed in claim 1, wherein the movement between the upper surface and the first or second member respectively is a sliding and/or twisting action.

3. The retractable mooring cleat as claimed in claim 1, wherein the cross-section of the first and/or second members are constant along their length, at least along the portion which is able to protrude from the frame.

4. The retractable mooring cleat as claimed in claim 1, wherein the first and/or second members are tapered towards their ends which extend from the frame.

5. The retractable mooring cleat as claimed in claim 1, wherein the first and second members have a circular cross-section.

6. The retractable mooring cleat as claimed in claim 1, wherein the first and second members are substantially straight.

7. The retractable mooring cleat as claimed in claim 1, wherein the first and second members are curved.

8. The retractable mooring cleat as claimed in claim 7, wherein the first and second members are curved in fixed radius arcs.

9. The retractable mooring cleat as claimed in claim 1, wherein the first and second members are helical and moved along their respective paths by a screwing action.

10. The retractable mooring cleat as claimed in claim 1, wherein a base plate forms said frame.

11. The retractable mooring cleat as claimed in claim 1, wherein each of the first and second members are each supported within the frame by at least one fixed bushing through which the first or second member respectively is able to slide.

12. The retractable mooring cleat as claimed in claim 11, wherein the first and second members are each supported within the frame by two fixed bushings that are formed from a compressible material.

13. The retractable mooring cleat as claimed in claim 11, wherein the bushing or bushings have an opening that matches the cross-sectional shape of the first and second members.

14. The retractable mooring cleat as claimed in claim 11, wherein the first and second members have lower ends that remain below the upper surface of the frame and upper ends that are extendable above an upper surface of the frame wherein the first and second members have a stop projecting outward at or near their lower ends and lower bushings on the respective first and second members include a depression shaped to receive the stop when the member is in its fully extended position.

15. The retractable mooring cleat as claimed in claim 1, wherein the first and second members have lower ends that remain below the upper surface of the housing and upper ends that are extendable above the housing's upper surface, wherein a first driving block or link member is pivotally connected at or near the lower end of the first member and a second driving block or link member is pivotally connected at or near the lower end of the second member and the actuation mechanism includes a source of motive energy connected to drive the first and second driving block or link members to thereby cause the first and second members to move along their respective paths.

16. The retractable mooring cleat as claimed in claim 15, wherein the first and second driving block or link members each include a rack formation and the source of motive energy is connected to rotate drive wheels, one of which engages with the rack formation on the first driving block or link member and another of which engages with the second driving block or link member.

17. The retractable mooring cleat as claimed in claim 16, wherein the source of motive energy comprises an electric motor that rotates a worm gear coupled to drive a worm gear wheel that is coupled to rotate the drive wheels.

18. The retractable mooring cleat as claimed in claim 17, wherein an actuating button is provided to manually disengage the source of motive energy from the drive wheels.

19. The retractable mooring cleat as claimed in claim 18, wherein the actuation mechanism comprises a plurality of interconnected gear wheels between a central drive wheel, that is driven directly by the worm gear wheel, and the rack formations and the actuating button comprise a lever adapted to disengage the central drive wheel from its connection to the worm gear wheel.

20. The retractable mooring cleat as claimed in claim 19, wherein the central drive wheel and the worm gear wheel are mounted on the same shaft with the worm gear wheel slidable and rotatable on the shaft and the central drive wheel fixed to the shaft so that it is movable axially with the shaft and rotatable thereon, wherein the central drive wheel and the worm gear wheel are engaged together by a dog clutch formed by features on their adjacent side surfaces when the shaft is in a first position and disengaged when the shaft is moved axially to a second position that moves the central drive gear away from the worm gear wheel.

21. The retractable mooring cleat as claimed in claim 1, wherein biasing means are provided to urge the first and second members away from their fully retracted positions.

22. The retractable mooring cleat as claimed in claim 21, wherein the biasing means comprise a spring that stores mechanical energy as the first and second members are retracted and is connected to provide a resultant torque to one of the first or second members in a direction to cause extension of the first and second members.

23. A retractable mooring cleat comprising:

a housing having an upper surface, at least one first member, the or each first member extendable from the upper surface of the housing along a respective first path, at least one second member, the or each second member extendable from an associated first member along a respective second path, and an actuation mechanism operable to cause the or each first member to move along their respective first paths between a fully extended position where the first and second members protrude from the upper surface and a fully retracted position where the first and second members are substantially flush with or below the upper surface and to cause the or each second member to move along their respective second paths to either protrude from or to retract within their associated first member, the first and second paths being enclosed entirely within the three-dimensional volume defined by the first and second members respectively when at their fully extended positions and a movement between the upper surface and the first member is a sliding action.

24. The retractable mooring cleat as claimed in claim 23, wherein extension and retraction of a second member occurs while its associated first member is fully extended.

25. The retractable mooring cleat as claimed in claim 23, wherein each first path is substantially straight and perpendicular to the housing's upper surface.

26. The retractable mooring cleat as claimed in claim 23, wherein each second path is substantially straight and perpendicular to the first path of its associated first member.

27. The retractable mooring cleat as claimed in claim 23, wherein the retractable mooring cleat includes one first member and at least two associated second members.

28. The retractable mooring cleat as claimed in claim 23, wherein the retractable mooring cleat includes two spaced apart first members, each including a single second member extendable therefrom wherein the respective second paths extend in opposite directions.

29. The retractable mooring cleat as claimed in claim 23, wherein the or each first member comprises a post having an oblong cross-sectional shape viewed in the direction of the first path.

30. The retractable mooring cleat as claimed in claim 23, wherein a base plate forms the outer surface of the housing.

31. The retractable mooring cleat as claimed in claim 1, wherein a housing forms said frame.

32. The retractable mooring cleat as claimed in claim 1, wherein said first and second members have a substantially square cross-section.

* * * * *